US009307312B2

(12) United States Patent
Kocalar et al.

(10) Patent No.: US 9,307,312 B2
(45) Date of Patent: Apr. 5, 2016

(54) AUDIO ACCESSORY WITH INTERNAL CLOCK

(71) Applicant: Apple Inc., Cupertino, CA (US)

(72) Inventors: Erturk D. Kocalar, Sunnyvale, CA (US); Saket R. Vora, San Francisco, CA (US); Dustin J. Verhoeve, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 383 days.

(21) Appl. No.: 13/839,117

(22) Filed: Mar. 15, 2013

(65) Prior Publication Data

US 2014/0270201 A1 Sep. 18, 2014

(51) Int. Cl.
*H04R 29/00* (2006.01)
*H04R 1/10* (2006.01)

(52) U.S. Cl.
CPC ..... *H04R 1/1041* (2013.01); *H04R 1/1025* (2013.01); *H04R 2201/103* (2013.01); *H04R 2201/107* (2013.01); *H04R 2420/01* (2013.01); *H04R 2420/05* (2013.01); *H04R 2420/09* (2013.01)

(58) Field of Classification Search
None
See application file for complete search history.

(56) References Cited

U.S. PATENT DOCUMENTS

| | | | |
|---|---|---|---|
| 4,792,986 | A | 12/1988 | Garner et al. |
| 4,968,929 | A | 11/1990 | Hauck et al. |
| 5,387,110 | A | 2/1995 | Kantner et al. |
| 5,442,243 | A | 8/1995 | Bailey |
| 6,012,105 | A | 1/2000 | Rubbmark et al. |
| 6,073,201 | A | 6/2000 | Jolley |
| 6,145,037 | A | 11/2000 | Sakakibara |
| 6,334,160 | B1 | 12/2001 | Emmert |
| 6,368,146 | B2 | 4/2002 | Abbott |
| 6,452,402 | B1 | 9/2002 | Kerai |
| 6,671,814 | B1 | 12/2003 | Kubo et al. |
| 6,718,417 | B1 | 4/2004 | Bachrach |
| 6,810,435 | B2 | 10/2004 | Palmer et al. |
| 6,836,814 | B2 | 12/2004 | Takaoka et al. |
| 6,973,658 | B2 | 12/2005 | Nguyen |
| 6,981,887 | B1 | 1/2006 | Mese et al. |
| 7,039,731 | B2 | 5/2006 | Hasegawa |
| 7,058,075 | B1 | 6/2006 | Wong et al. |
| 7,094,086 | B2 | 8/2006 | Teicher |
| 7,104,848 | B1 | 9/2006 | Chou |
| 7,123,022 | B2 | 10/2006 | Parket et al. |
| 7,216,191 | B2 | 5/2007 | Sagues et al. |

(Continued)

FOREIGN PATENT DOCUMENTS

| | | | |
|---|---|---|---|
| DE | 202004012084 | U1 | 11/2004 |
| FR | 2138961 | A1 | 1/1973 |

(Continued)

*Primary Examiner* — Regina N Holder
(74) *Attorney, Agent, or Firm* — Kilpatrick Townsend & Stockton LLP

(57) ABSTRACT

An audio accessory is configured to receive and store meta data from a media player, including the media asset identification and current play position. The audio accessory is configured to independently track the current play position of the media asset. When the audio accessory is disconnected from the first media player the audio accessory is configured to store the independently tracked current play position in memory. After the audio accessory is subsequently connected to a second media player, the second media player may retrieve the meta data from the audio accessory and use it to load the media asset on the second player and resume play from the stored current play position.

20 Claims, 6 Drawing Sheets

(56) References Cited

U.S. PATENT DOCUMENTS

| | | | | |
|---|---|---|---|---|
| 7,277,966 | B2 | 10/2007 | Hanson et al. | |
| 7,392,946 | B2 | 7/2008 | Hellström et al. | |
| 7,442,091 | B2 | 10/2008 | Salolmon et al. | |
| 7,458,825 | B2 | 12/2008 | Atsmon et al. | |
| 7,463,042 | B2 | 12/2008 | Pereira | |
| 7,496,671 | B2 | 2/2009 | Engel et al. | |
| 7,529,870 | B1 | 5/2009 | Schubert et al. | |
| 7,533,202 | B2 | 5/2009 | Newman | |
| 7,565,458 | B2 | 7/2009 | Thijssen et al. | |
| 7,577,887 | B2 | 8/2009 | Kim | |
| 7,589,536 | B2 | 9/2009 | Terlizzi et al. | |
| 7,716,400 | B2 | 5/2010 | Raines | |
| 7,717,717 | B1 | 5/2010 | Lai | |
| 7,743,187 | B2 | 6/2010 | Choi et al. | |
| 7,863,906 | B2 | 1/2011 | Terlizzi et al. | |
| 7,890,284 | B2 | 2/2011 | Patterson et al. | |
| 7,969,702 | B2 | 6/2011 | Herrmann | |
| 8,799,527 | B2 | 8/2014 | Mullins et al. | |
| 2003/0068033 | A1 | 4/2003 | Kiko | |
| 2003/0220988 | A1 | 11/2003 | Hymel | |
| 2004/0023560 | A1 | 2/2004 | Swoboda | |
| 2005/0015525 | A1 | 1/2005 | Cahill et al. | |
| 2005/0021890 | A1 | 1/2005 | Baker et al. | |
| 2005/0097212 | A1 | 5/2005 | Engel et al. | |
| 2005/0246477 | A1 | 11/2005 | Adams et al. | |
| 2006/0047861 | A1 | 3/2006 | Hung et al. | |
| 2006/0047982 | A1 | 3/2006 | Lo et al. | |
| 2006/0156415 | A1 | 7/2006 | Rubinstein | |
| 2007/0001691 | A1 | 1/2007 | Pereira | |
| 2007/0082634 | A1 | 4/2007 | Thijssen et al. | |
| 2007/0178771 | A1 | 8/2007 | Goetz et al. | |
| 2007/0245058 | A1 | 10/2007 | Wurzburg et al. | |
| 2007/0287302 | A1 | 12/2007 | Lindberg et al. | |
| 2008/0164934 | A1 | 7/2008 | Hankey et al. | |
| 2008/0167828 | A1 | 7/2008 | Terlizzi et al. | |
| 2008/0274633 | A1 | 11/2008 | Teicher | |
| 2008/0320190 | A1 | 12/2008 | Lydon et al. | |
| 2009/0092378 | A1* | 4/2009 | Ho et al. | 386/124 |
| 2009/0108848 | A1 | 4/2009 | Lundquist | |
| 2009/0132076 | A1 | 5/2009 | Holden et al. | |
| 2009/0193180 | A1 | 7/2009 | Ito | |
| 2009/0290725 | A1* | 11/2009 | Huang | 381/103 |
| 2010/0042826 | A1 | 2/2010 | Bull et al. | |
| 2010/0075604 | A1 | 3/2010 | Lydon et al. | |
| 2010/0161842 | A1 | 6/2010 | Shan et al. | |
| 2010/0180063 | A1 | 7/2010 | Ananny et al. | |
| 2010/0279554 | A1 | 11/2010 | Steijner | |
| 2011/0055407 | A1 | 3/2011 | Lydon et al. | |
| 2011/0167176 | A1 | 7/2011 | Yew et al. | |
| 2012/0042347 | A1* | 2/2012 | Yasuda | 725/89 |
| 2012/0047368 | A1 | 2/2012 | Chinn et al. | |
| 2012/0188916 | A1* | 7/2012 | Miyake et al. | 370/277 |
| 2012/0231835 | A1 | 9/2012 | Zhang et al. | |
| 2012/0265911 | A1 | 10/2012 | Connolly | |
| 2013/0128933 | A1* | 5/2013 | Hsu et al. | 375/219 |
| 2014/0075067 | A1 | 3/2014 | Mullins et al. | |
| 2014/0075069 | A1 | 3/2014 | Mullins et al. | |

FOREIGN PATENT DOCUMENTS

| | | | |
|---|---|---|---|
| JP | 6155974 | A | 6/1994 |
| JP | 2003217728 | A | 7/2003 |
| WO | 2005013436 | A1 | 2/2005 |
| WO | 2006013553 | A2 | 2/2006 |
| WO | 2008065659 | A2 | 6/2008 |
| WO | 2009069969 | A2 | 6/2009 |

* cited by examiner

AUDIO ACCESSORY WITH INTERNAL CLOCK

BACKGROUND OF THE INVENTION

The present invention relates generally to audio accessories, such as headphones that can be connected to a media player or other electronic device.

A wide variety of electronic devices are available for consumers today and as a result consumers often possess more than one electronic device. Each electronic device may have particular capabilities suited for unique uses, and as a result the consumer may transition from one device to another throughout the day. As an example, a consumer may use a cellular phone connected to head phones to listen to an audio book during their drive to the gym. Once arriving at the gym, the consumer may wish to transition the head phones to a smaller media player for their workout. However, during this transition the consumer may have to find the audio book they were listening to on the new electronic device and search for the place they left off. Such transitions may result in consumer annoyance and detract from a desired seamless experience.

BRIEF SUMMARY OF THE INVENTION

Embodiments of the invention pertain to audio accessories for use with a variety of electronic devices. In some embodiments the audio accessories connect to a media player using a wired and/or wireless input channel. The audio accessory may receive both audio input and meta data associated with a media asset on the media player. Circuitry within the audio accessory may be equipped to store at least some of the meta data in memory and to receive a current play position of the media asset on the media player. The circuitry may have a clock unit that can be used to independently track the current play position of the media asset on the media player.

The audio accessory may be further configured to detect a disconnect event between the accessory and the media player. After the disconnect event, the circuitry within the audio accessory may retrieve the independently tracked current play position from the clock unit and store it in its memory. In some embodiments, the audio accessory may be equipped with a temporary power supply to supply power to the circuitry after the disconnect event.

When the audio accessory is connected to a new media player, the accessory may transmit some of the meta data to the new media player. In some embodiments, the new media player may receive a media asset identification and a current play position. The new media player may then load the identified media asset and initiate it from the stored current play position. Thus, the audio accessory may provide a user with a seamless experience when transitioning from one media player to another.

To better understand the nature and advantages of the present invention, reference should be made to the following description and the accompanying figures. It is to be understood, however, that each of the figures is provided for the purpose of illustration only and is not intended as a definition of the limits of the scope of the present invention.

DETAILED DESCRIPTION OF THE INVENTION

Certain embodiments of the present invention relate to accessories for electronic devices. While the present invention can be useful to produce accessories for a wide variety of electronic devices, some embodiments of the invention are particularly useful for producing audio accessories that enable a more seamless transition from one media player to another, as described in more detail below.

Figures 1, 2:
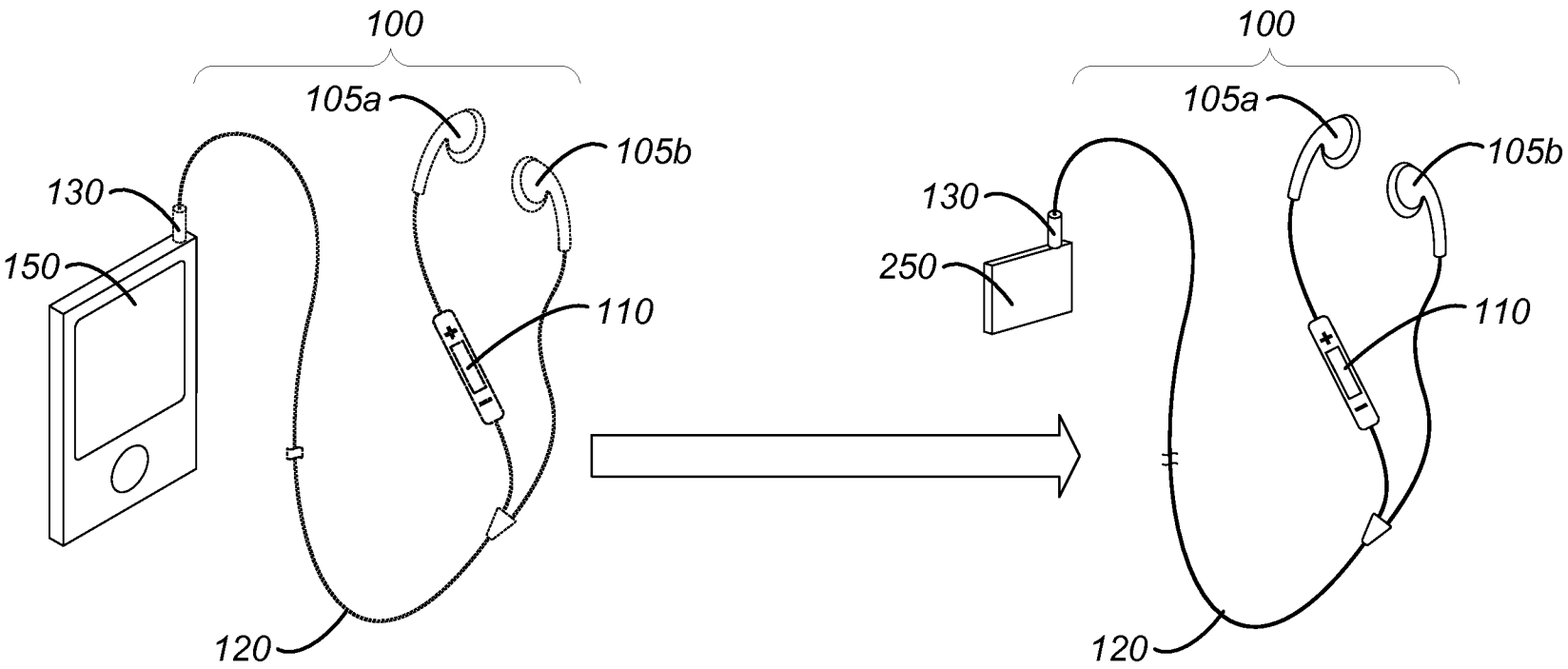
FIG. 1 is an illustration of an audio accessory connected to a media player.
FIG. 2 is an illustration of an audio accessory connected to a media player.

FIGS. 1 and 2 illustrate an example of audio accessory 100 transitioning from media player 150 to media player 250. As shown in FIG. 1, audio accessory 100 may be first connected to media player 150 through electrical connector 130. In some embodiments, media players 150, 250 may include: MP3 players, smart phones, tablet computers, personal computers, laptops, a vehicular audio system or any other device capable of playing media. Audio accessory 100 may further include a cord 120, two speaker elements 105*a*, 105*b* and a volume control/microphone 110. Accessory 100 is shown in the figures as a pair of headphones, however the invention is not limited to headphones and in other embodiments accessory 100 could be a portable speaker system or other audio accessory. A media asset may be played on media player 150 and actively listened to on audio accessory 100 through speaker elements 105*a*, 105*b*. Before the media asset has reached its end, audio accessory 100 may be disconnected from media player 150 and later connected to media player 250 (see FIG. 2). In some embodiments, audio accessory 100 may facilitate a seamless user experience by storing meta data associated with the media asset residing on media player 150, including data that identifies the song or track being played when accessory 100 is disconnected from media player 150, along with information that indicates the play position of the song or track upon the disconnect event, and transferring the meta data and play position to media player 250 as discussed in more detail below.

Figure 3:
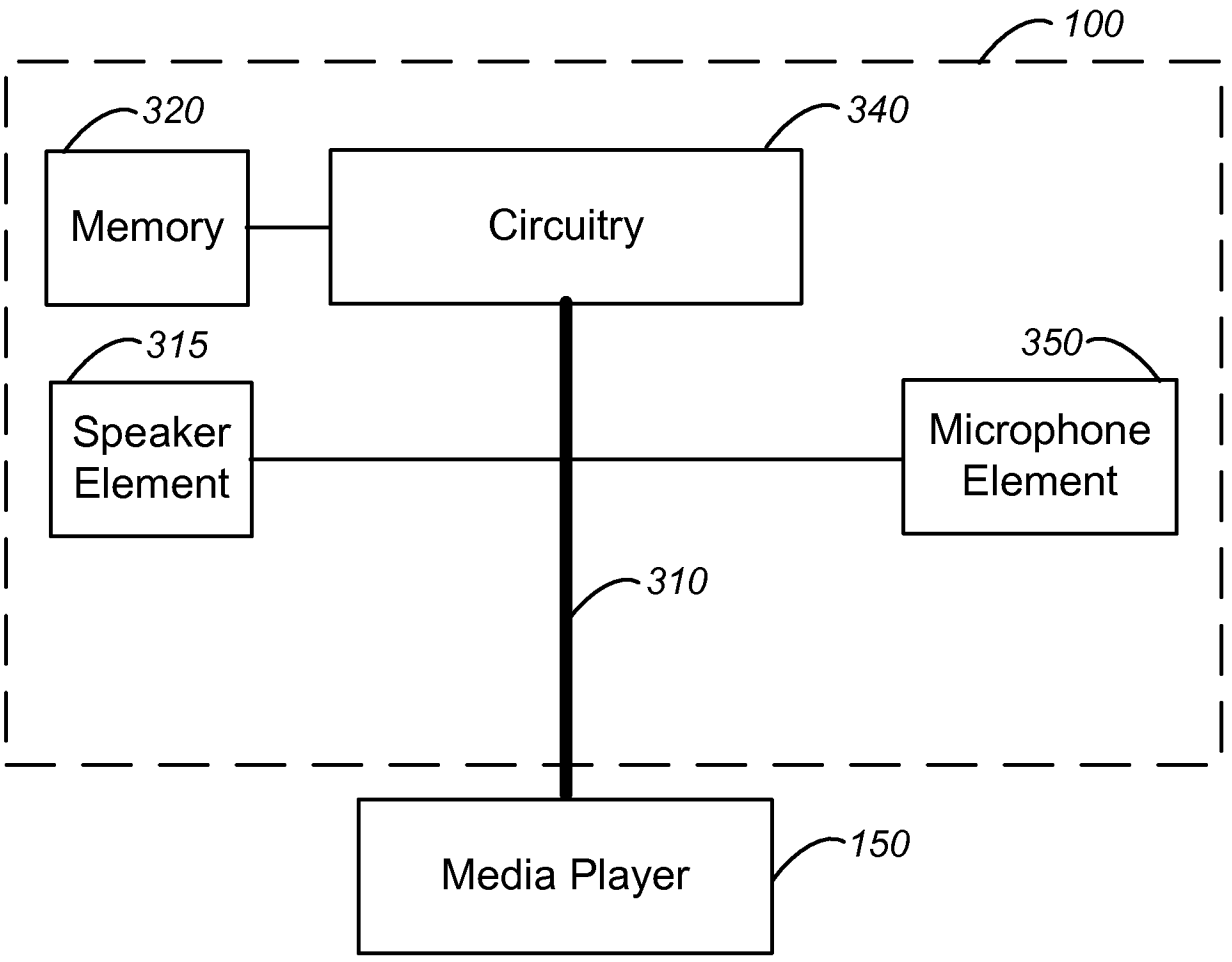
FIG. 3 is a simplified schematic of an audio accessory connected to a media player.

FIG. 3 shows a schematic view of one embodiment of audio accessory 100 connected to media player 150 with input channel 310. In some embodiments, input channel 310 may be a wired connection and connected to media player 150 with an electrical connector, such as a TRRS connector. In other embodiments input channel 310 may be a wireless connection between accessory 100 and media player 150. In other embodiments input channel 310 may include multiple channels (e.g., a first channel may be used for audio and a different channel may be used for meta data). Input channel 310 may be wired, wireless or a mixture thereof. In some embodiments the first channel may include separate left and right audio channels.

A media asset (e.g., song, movie, audio book) may be stored on media player 150 and played for the user through audio accessory 100. Input channel 310 may be configured to receive an audio signal and meta data from media player 150 corresponding to the media asset. In some embodiments, at least one speaker element 315 may be coupled to input channel 310 to receive the audio signal from media player 150 and convert the audio signal to audible audio content for the user. In further embodiments input channel 310 may include a first audio input channel configured to receive a left channel audio signal from media player 150 and a second audio input channel configured to receive a right channel audio signal from the media player. The audio accessory may include a left ear speaker element 105*a* (see FIG. 1) coupled to the first audio input channel to receive the left channel audio signal and convert the left channel audio signal to audible audio content, and a right ear speaker 105*b* (see FIG. 1) coupled to the second audio input channel to receive the right channel audio signal and convert the right channel audio signal to audible audio content. In further embodiments a microphone element 350 may be used in audio accessory 100 for receiving an audio signal from the user.

Audio accessory 100 may further include a computer-readable memory 320 and circuitry 340 configured to receive meta data corresponding to the media asset. Memory 320 may be any type of memory including non-volatile memory that can retain information without power. In some embodiments, memory 320 may be a flash memory or a ferroelectric random access memory. Circuitry 340 may be configured to store at least some of the meta data in computer-readable memory 320. In some embodiments the meta data may include an identification of the media asset on media player 150, while in further embodiments the meta data may include a play list, play position or any other meta data associated with the media asset. In other embodiments the meta data may include the status of the media asset on the media player (e.g., current play position, pause, skip forward, skip backward). In some embodiments, the current play position of the media asset may be communicated to audio accessory 100 through input channel 310, and circuitry 340 may be used to independently track the current play position of the media asset. More specifically, once media player 150 transmits the current play position to circuitry 340, circuitry 340 may track the current play position of the media asset independent from media player 150. In some embodiments, the current play position of a particular media asset may be transferred only once to audio accessory 100 when the media asset is started, while in other embodiments media player 150 may transmit the current play position at a regular time intervals. In further embodiments, the current play position of a media asset may be transferred to audio accessory 100 when the media asset is paused, stopped, forwarded, rewound or otherwise manipulated by the user on the media player.

Circuitry 340 may further be configured to detect a disconnect event between media player 150 (see FIG. 1) and input channel 340, and in response to the disconnect event, store the current play position of the media asset in the computer-readable memory. More specifically, when a disconnect event is detected, circuitry 340 may retrieve the current play position from internal clock unit 430 (see FIG. 4) and save it in memory 320.

In some embodiments, audio accessory 100 may be subsequently connected to a different media player 250 (see FIG. 2). Circuitry 340 may send at least some of the meta data sufficient to identify the media asset being played at the time of disconnect that is stored in computer-readable memory 320 to media player 250 along with the play position at the disconnect event. In some embodiments this exchange of information between circuitry 340 and media player 250 may be in response to a request from media player 250 for historical information, while in other embodiments the exchange may be initiated by accessory 100. Media player 250 may then load the identified media asset and initiate play at the current play position stored in memory, providing a seamless experience for the user. In some embodiments the media asset may not reside on media player 250. In response, media player 250 may acquire the media asset from a wired or wireless connection and the user may be prompted for approval, as discussed in more detail below. Thus, a user may use audio accessory 100 to listen to a media asset on a first media player and by simply disconnecting the accessory from the first media player and connecting it to the second media player the same media may be loaded on the second media player and resumed at the play position when the disconnect event occurred. In some embodiments the media asset may reside on the second media player, however in other embodiments the second media player may automatically retrieve the media asset from a remote location, such as but not limited to, a server, another device or the cloud. In some embodiments the media asset may reside in a cloud storage arrangement and media player 250 may connect to the internet to download the media asset from the cloud. In other embodiments, the media asset may be streamed content and media player 250 may establish a connection with the streaming host to resume streaming the media asset from the last current play position.

Figure 4:
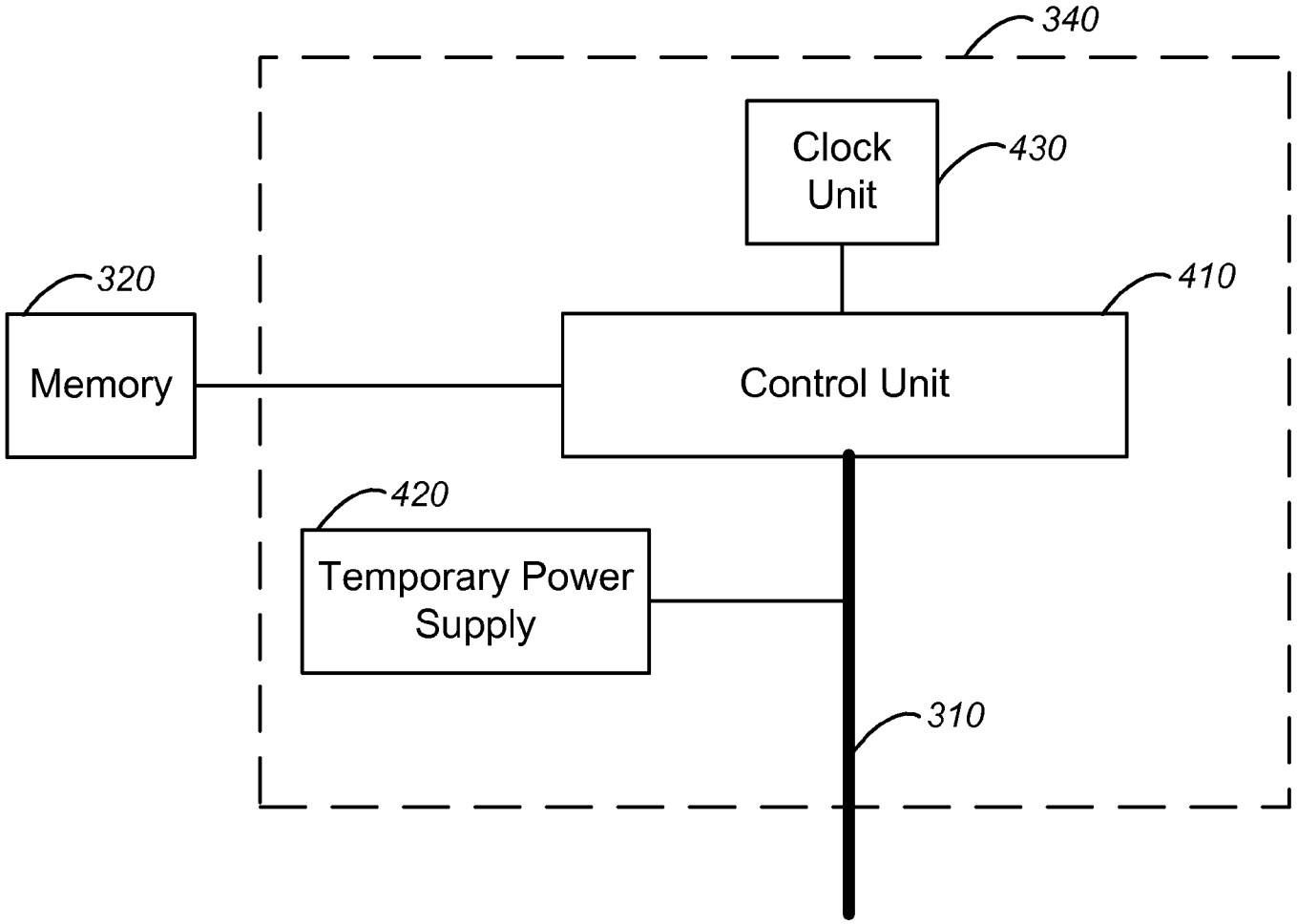
FIG. 4 is a simplified schematic of the circuitry within an audio accessory.

FIG. 4 illustrates a simplified schematic view of one embodiment of circuitry 340. Circuitry 340 may include a clock unit 430 for independently tracking the current play position of the media asset on media player 150, 250. Clock unit 430 may include various designs, as discussed in more detail below. Clock unit 430 may be electrically connected to a control unit 410. Control unit 410 may perform the instructions of a computer program by performing the basic arithmetical, logical, input/output operations of the system and communicate with media players 150, 250 through input channel 310. More specifically, control unit 410 may transfer data into and out of computer-readable memory 320 and employ clock unit 430 to independently track the current play position of a media asset.

In some embodiments, circuitry 340 may be electrically powered by input channel 310 and may also include a temporary power supply 420. In other embodiments, circuitry may be powered by an internal power storage device (not shown) or the bus used to power microphone element 350 (see FIG. 3). Temporary power supply 420 may supply power to control unit 410, memory 320 and clock unit 430 such that when input channel 310 is disconnected from the media player that adequate power remains for the control unit to send the current play position to the computer-readable memory and for the computer-readable memory to store the information. In other embodiments, temporary power supply 420 may include a battery, a capacitor, or other energy storage device.

Figure 5:
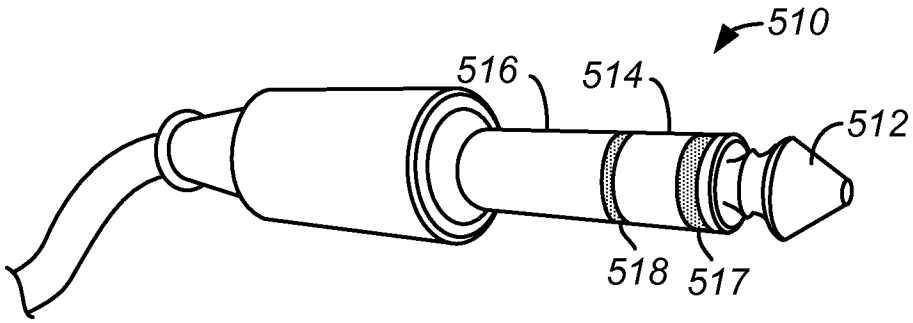
FIG. 5 is a diagram that illustrates a perspective view of an audio plug.
Figure 6:
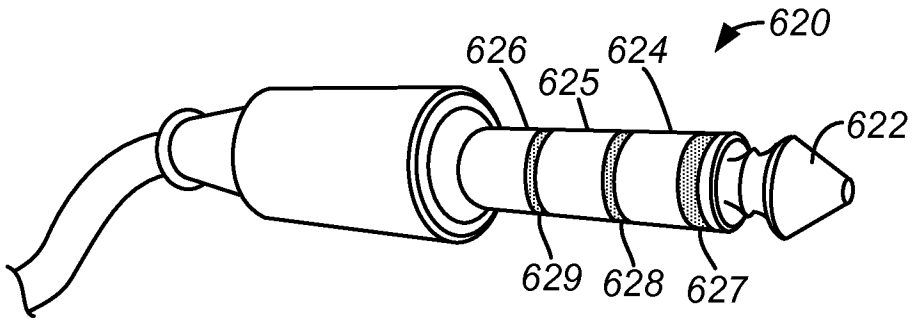
FIG. 6 is a diagram that illustrates a perspective view of an audio plug.

In some embodiments, input channel 310 may be wired and electrically coupled to media player 150, 250 with example audio plug connectors illustrated in FIGS. 5 and 6. As shown in FIG. 5, plug 510 includes a conductive tip 512, a conductive sleeve 516 and a conductive ring 514 electrically isolated from the tip 512 and the sleeve 516 by insulating rings 517 and 518. The three conductive portions 512, 514, 516 are for left and right audio channels and a ground connection, respectively. Plug 620, shown in FIG. 6, includes four conductive portions: a conductive tip 622, a conductive sleeve 626 and two conductive rings 624, 625 and is thus sometime referred to as a TRRS (tip, ring, ring, sleeve) connector. The four conductive portions 622, 624, 625 and 626 are electrically isolated by insulating rings 627, 628 and 629 and are typically used for left and right audio, ground and microphone signals, respectively.

Standard audio plugs are available in three sizes according to the outside diameter of the plug: a 6.35 mm (¼") plug, a 3.5 mm (⅛") miniature plug and a 2.5 mm (3/32") subminiature plug. The plugs include multiple conductive regions that extend along the length of the connectors in distinct portions of the plug such as the tip, sleeve and one or more middle portions or "rings" located between the tip and sleeve, resulting in the connectors often being referred to as TRS (tip, ring and sleeve) connectors. Other electrical connectors, including optical connectors or proprietary connectors, such as the reversible 8-pin connector manufactured by Apple, may be used in further embodiments.

Referring now to clock unit 430 in FIG. 4, myriad methods may be employed to track the current play position of the media asset. In some embodiments, clock unit 430 may include an inductor-capacitor type oscillator, a resistor-capacitor type oscillator, a crystal type oscillator or any other circuit that can track time. In some embodiments clock unit 430 may be integral with control unit 410 while in other embodiments the clock unit may be separate. In further embodiments a portion of clock unit 430 may be integral with control unit 410 and a portion of clock unit may be separate such that it can be tuned or adjusted. Time keeping clock circuits are well-known to those of skill in the art and any such device may be employed without departing from the invention.

An example inductor-capacitor type oscillator may work as follows. If a charged capacitor is connected across an inductor, charge will start to flow through the inductor, building up a magnetic field around it and reducing the voltage on the capacitor. Eventually all the charge on the capacitor will be gone and the voltage across it will reach zero. However, the current will continue, because inductors resist changes in current. The energy to keep it flowing is extracted from the magnetic field, which will begin to decline. The current will begin to charge the capacitor with a voltage of opposite polarity to its original charge. When the magnetic field is completely dissipated the current will stop and the charge will again be stored in the capacitor, with the opposite polarity as before. Then the cycle will begin again, with the current flowing in the opposite direction through the inductor. The charge flows back and forth between the plates of the capacitor, through the inductor. The oscillation frequency is determined by the capacitance and inductance values. The resonant output may be used by the control unit to track time.

An example resistor-capacitor type oscillator may work as follows. A resistor connects to a current source. Current from the resistor flows into a capacitor, building electric charge in it. The rate of charge depends on the values of both the resistor and capacitor. Large resistances will lower the current and make the capacitor charge more slowly. A larger capacitor takes longer to charge. The capacitor charges on a logarithmic curve. An electronic switch called a comparator detects the voltage rising across the capacitor as it charges. When the voltage passes a critical threshold, the comparator causes the capacitor to discharge its current. For most oscillators, the discharge is nearly instant compared to the charge time. The resistor still feeds current to the capacitor, so it charges again until the comparator discharges it. This charge-discharge cycle produces a voltage waveform across the capacitor, called a saw-tooth wave. The saw-tooth wave may be used by the control unit to track time.

An example crystal type oscillator may work as follows. A regular timing crystal contains two electrically conductive plates, with a slice or tuning fork of quartz crystal sandwiched between them. During startup, the circuit around the crystal applies a random noise AC signal to it, and purely by chance, a tiny fraction of the noise will be at the resonant frequency of the crystal. The crystal will therefore start oscillating in synchrony with that signal. As the oscillator amplifies the signals coming out of the crystal, the crystal's frequency will become stronger, eventually dominating the output of the oscillator. Natural resistance in the circuit and in the quartz crystal typically filter out all the unwanted frequencies. The crystal oscillator circuit sustains oscillation by taking a voltage signal from the quartz resonator, amplifying it, and feeding it back to the resonator. The rate of expansion and contraction of the quartz is the resonant frequency, and is determined by the cut and size of the crystal. The resonant output may be used by the control unit to track time.

Figure 7:
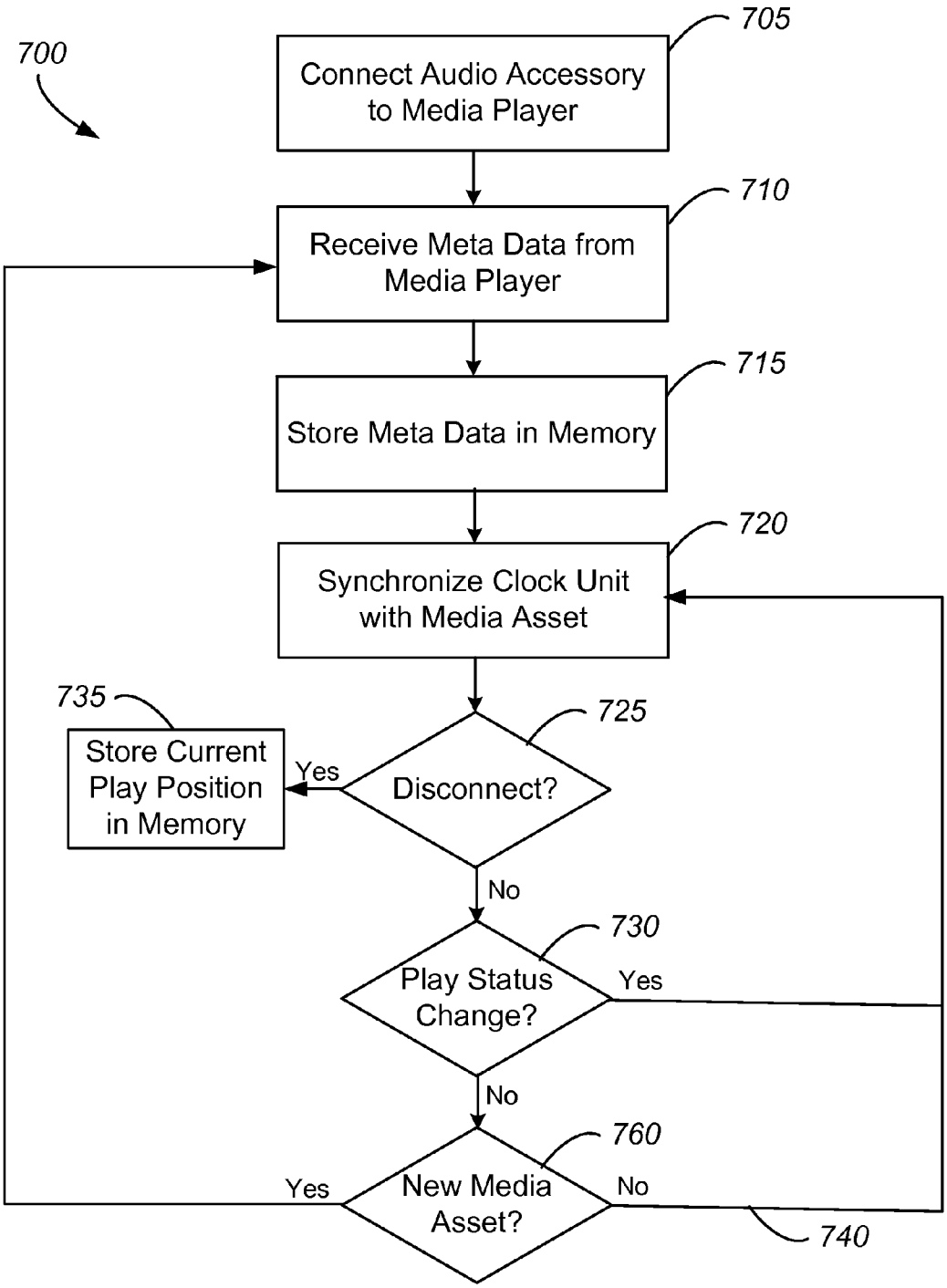
FIG. 7 is a process by which an audio accessory may communicate with a media player.

An exemplary simplified process 700 operating an audio accessory in accordance with embodiments described herein, is depicted in FIG. 7. In step 705 the audio accessory is connected to a media player. The connection may be wired and may thus have one or more cords terminated with an electrical connector that interfaces with a receptacle in the media player. In other embodiments, the connection may be wireless using a Blue Tooth, ZigBee, or other wireless protocol. In step 710 the media player has been activated, playing the media asset and establishing communications with the audio accessory such that the audio accessory can receive audio/video and meta data from the media player. In some embodiments the meta data may include, a play list, a position in the play list, a media asset identification, a current play position of the media asset, or any other information regarding the media asset. In further embodiments, the audio/video data may include one or more audio and/or video tracks. In some embodiments, the audio data may be received by the audio accessory and fed into one or more speaker elements that convert the audio data to audible audio content. The communications may be established using any known techniques for transferring data.

In step 715 at least some of the transmitted meta data from the media player is stored in the computer-readable memory of the audio accessory. In some embodiments the stored meta data may include the name of the media asset, an media asset identification, a playlist identification a current play position of the media asset, a storage location of the media asset a play time of the media asset or any other data associated with the media asset. In step 720 the clock unit within the audio accessory may be synchronized with the current play position of the media asset on the media player. More specifically, the clock unit may use the current play position of the media asset on the media player to track the current play position of the media asset, independent of the media player, as the media asset is played. In some embodiments, when a new media asset (song) is started from its beginning, the current play position tracked within the audio accessory is set to zero. As the media asset is played, clock unit 430 tracks the current play position of the media asset, independent of the media player. In further embodiments, the current play position of the media asset may be repeatedly sent to the audio accessory separated by a time interval. More specifically, the clock unit 430 may independently track the current play position of the media asset, however the clock unit may be repeatedly updated with a current play position sent from the media player. In other embodiments, the starting play position of the media asset may be sent to the audio accessory when the media asset is started and the play position may only be updated when the user makes a play status change such as stop, pause, fast-forward, rewind or any other change to the play position of the media asset as discussed below. In step 725 the audio accessory may detect a disconnect event where the audio accessory is no longer connected to the media player. In some embodiments this may include unplugging a connector, while in other embodiments a wireless connection may be lost. If a disconnect event is detected, the process proceeds to step 735 where circuitry within the audio accessory is configured to retrieve the current play position of the media asset from the clock unit and store it in computer-readable memory within the audio accessory. Some embodiments may have a temporary power supply as part of the audio accessory to supply power for this operation after a disconnect event.

If a disconnect event is not detected in step 725, the process continues to step 730. In step 730 if there was a play status change of the media asset such as fast-forward, rewind, pause, or other status change the process will proceed to step 720 where the clock unit in the accessory will be synchronized with the media asset. More specifically, if the user makes a play status change on the media player the media player may send an updated current play position to the audio accessory to be stored in memory. The clock unit may then be set to zero and used in conjunction with the current play position to track the current play position of the media asset from when the status change was made. For example, if a user is listening to a media asset and presses rewind then play, the media player may send an updated current play position to the audio accessory to be stored in memory. The clock unit may be simultaneously reset to zero and used to track how much play time has elapsed since the updated play position has been received and stored. Myriad other methods may be used to track the play position of the media asset without departing from the invention.

If, in step 730 there is no play status change, the process may proceed to step 760. In step 760, if a new media asset has been selected on the media player the process returns to step 710 where meta data associated with the new media asset is received by the audio accessory. If, however the same media asset continues to play, the process may hold and wait for a disconnect event at step 725, or the process may follow optional path 740 to step 720, resynchronizing the clock unit on a regular time interval. In step 720 the clock unit in the audio accessory may be resynchronized with the media player to ensure accurate time keeping by the clock unit. This resynchronization loop may occur repeatedly with a time interval separating the resynchronization events. For example, in various embodiments, resynchronization may occur every 10 seconds, every 30 seconds, every 60 seconds or at some other predetermined interval.

Figure 8:
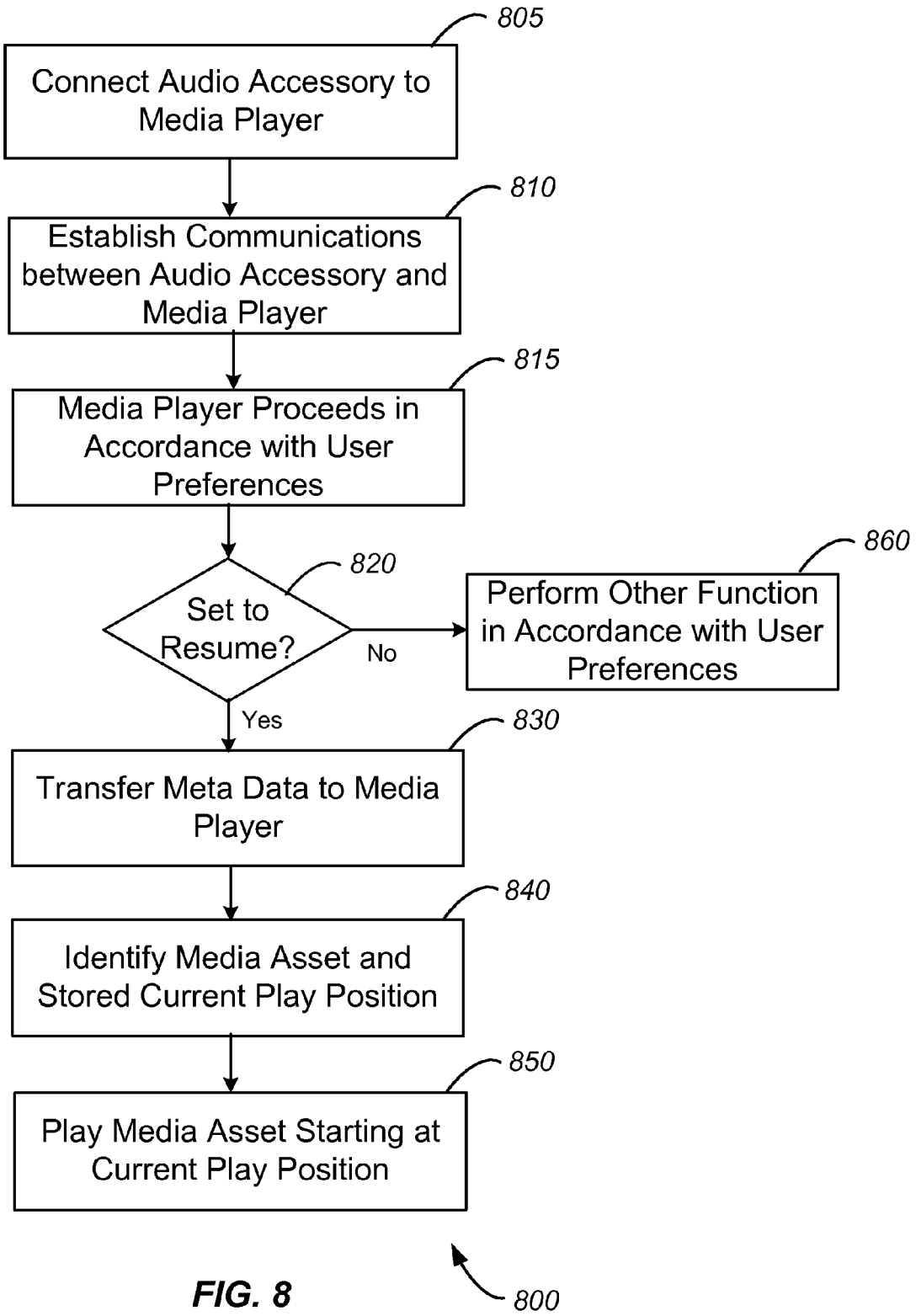
FIG. 8 is a process by which an audio accessory may communicate with a media player.

An example simplified process 800 operating an audio accessory in accordance with embodiments described herein, is depicted in FIG. 8. In this process it is understood that the audio accessory has already received and stored meta data from a prior connection to a media player. In step 805 the audio accessory is connected to a new media player. In step 810 the media player may establish communication with the audio accessory. In some embodiments the media player may recognize the audio accessory and communicate with the control unit within the audio accessory. In other embodiments the media player may negotiate with the audio accessory to determine an appropriate protocol to establish communications. In one embodiment, a communication protocol that packs audio and USB data together in a single data stream may be employed, while in other embodiments an RS-232 or other type of communication protocol may be used.

In step 815 the media player may proceed in accordance with user preferences that may be stored within the media player or with preferences that may be selected once communications are established between the media player and the audio accessory. More specifically, the user may preselect and store their preference in the media player to resume playback of a media asset that was last played through the audio accessory. Alternatively, once communication is established between the media player and the audio accessory, the user may be prompted by the media player to determine if the user wants to resume playback of a media asset that was last played through the audio accessory. In step 820, if the user preference is set to resume playback of a media asset last played on the audio accessory, then the process moves to step 830. However, if the user preference is not set to resume, then the process proceeds to step 860 and the media player performs a different function in accordance with the user preferences. If the process proceeds to step 830 the meta data from the last played media asset stored in the audio accessory memory is transferred to the media player. The media player may download the meta data using any communication protocol known for transferring data.

In step 840 the media player may use the meta data downloaded from the audio accessory to identify the media asset and the stored current play position. In some embodiments the media player may use meta data consisting of the name of the media asset, the location of the media asset and the stored current play position of the media asset when last played through the audio accessory. In some embodiments, the name of the media asset may simply be the name of the song and the name of the artist. In other embodiments software may assign a unique identification to each media asset and the unique identification may be the only meta data required to identify the media asset. Other meta data may also be downloaded from the audio accessory and employed by the media player such as, but not limited to a play list, a position in a play list, or any other information regarding the media asset. In step 850 the media player may acquire the media asset if it is not already stored in memory of the media player. In some embodiments the media player may acquire the media asset through a wireless or a wired communication link. Once the media asset has been loaded, or at least partially loaded into the memory of the media player, the media player may use the stored current play position and resume playback from that location. This process may provide the user with a seamless user experience when transitioning an audio accessory from one media player to another.

As an illustrative example of the process described in FIGS. 7 and 8, a user having two media players will be used. The user may be listening to the song Pinball Wizard by Elton John on his smart phone through headphones in the car while on the way to the gym. The song may end and a new song called Levon may start playing on the smart phone. When Levon starts playing, the smart phone sends meta data to the audio accessory including the name of the song, Levon, the artist, Elton John and the current play time of the song which may only be 0.5 seconds from the beginning. The audio accessory receives the meta data and stores it into memory. Simultaneously, the audio accessory may initiate the internal clock unit to track the elapsed play time of the song since receiving the meta data. After the song plays for 50 seconds the user arrives at the gym and unplugs the audio accessory from the smart phone. The clock unit in the audio accessory sends the current play time of 50 seconds to the memory in the audio accessory and the memory stores the information. Once the user starts their workout they plug the audio accessory into a small media player. The media player recognizes the audio accessory and establishes communication with it. The user has set a preference in the media player to automatically resume playback of media that was last played on the audio accessory. The media player then downloads meta data from the audio accessory memory including the song, Levon, the artist, Elton John and the last current playtime of the song which is the 0.5 seconds plus the 50 seconds, and resumes playback at 50.5 seconds.

It will be appreciated that the audio accessory, media players and media assets described herein are illustrative and that variations and modifications are possible. For instance, the media asset may be a movie, a video, an audio book or other media. The media asset may reside on the media player or may be a streaming or virtual media asset. The media player may be an MP3 player, smart phone, tablet computer, personal computer, laptop, vehicular audio system or any other device capable of playing media. For example, a user may be watching a movie on a laptop computer at home where they unplug the audio accessory and resume playback on a train from their smart phone. The audio accessory may be a set of headphones or may be any other type of accessory that interfaces with a media player. Further examples may include transferring an audio accessory from a tablet computer to a very small MP3 player where the MP3 player does not have wireless capability. In this example, because the MP3 player does not have wireless capability the only way it can determine the media asset and the last known play position of the media asset is by downloading it from the memory in the media asset.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. A pair of headphones for presenting audio content to a user, the pair of headphones comprising:

an input channel connected to a media player, the input channel configured to receive an audio signal and meta data corresponding to a media asset residing on the media player;

at least one speaker element coupled to the input channel to receive the audio signal and convert the audio signal to audible audio content;

a non-transitory computer-readable memory; and circuitry configured to: (i) receive the meta data corresponding to the media asset and store at least some of the meta data in the computer-readable memory, (ii) track a current play position of the media asset independent of the media player, (iii) detect a disconnect event between the media player and the input channel, and (iv) in response to the disconnect event, store the current play position of the media asset in the computer-readable memory.

2. The pair of headphones set forth in claim 1 wherein the at least some of the stored meta data comprises an identification of the media asset.

3. The pair of headphones set forth in claim 1 wherein the at least some of the stored meta data comprises a play list and a position in the play list.

4. The pair of headphones set forth in claim 1 wherein the input channel is a wireless channel.

5. The pair of headphones set forth in claim 1 wherein the input channel is within an electrical connector that electrically connects the pair of headphones to the media player.

6. The pair of headphones set forth in claim 5 wherein the electrical connector is an audio plug connector.

7. The pair of headphones set forth in claim 1 wherein the circuitry includes a clock unit and is configured to synchronize the clock unit with the media asset to independently track the current play position.

8. The pair of headphones set forth in claim 7 wherein the clock unit comprises a resistor-capacitor type oscillator.

9. The pair of headphones set forth in claim 7 wherein the clock unit comprises an inductor-capacitor type oscillator.

10. The pair of headphones set forth in claim 7 wherein the clock unit comprises a crystal type oscillator.

11. The pair of headphones set forth in claim 1 wherein the circuitry comprises a control unit and a temporary power supply.

12. A pair of headphones for presenting audio content to a user, the head phones comprising:

a first audio input channel configured to receive a left channel audio signal from a media player;

a second audio input channel configured to receive a right channel audio signal from the media player;

a left ear speaker coupled to the first audio input channel to receive the left channel audio signal and convert the left channel audio signal to audible audio content;

a right ear speaker coupled to the second audio input channel to receive the right channel audio signal and convert the right channel audio signal to audible audio content;

a non-transitory computer-readable memory;

circuitry configured to: (i) receive meta data associated with a media asset on the media player and store at least some of the meta data in the computer-readable memory, (ii) track a current play position of the media asset independent of the media player, (iii) detect a disconnect event between the media player and the first and second audio input channels, and (iv) in response to the disconnect event, store the current play position of the media asset in the computer-readable memory.

13. The pair of head phones set forth in claim 12 wherein the circuitry is electrically powered by the media player.

14. The pair of head phones set forth in claim 12 wherein the circuitry includes a clock unit and is configured to synchronize the clock unit with the media asset to track the current play position.

15. The pair of head phones set forth in claim 12 wherein the circuitry comprises a control unit and a temporary power supply.

16. The pair of head phones set forth in claim 15 wherein the temporary power supply supplies power to the circuitry after the disconnect event.

17. The pair of head phones set forth in claim 12 wherein the at least some of the meta data stored in the computer-readable memory comprises an identification of the media asset.

18. The pair of head phones set forth in claim 12 wherein the at least some of the meta data stored in the computer-readable memory comprises a play list and a position in the play list.

19. A portable listening device for presenting audio content to a user, the portable listening device comprising:

an input channel for receiving an audio signal corresponding to media content transmitted by a media player, wherein the media player is connected to the input channel;

at least one speaker element coupled to the input channel to receive the audio signal and convert the audio signal to audible audio content;

a non-transitory computer-readable memory;

a clock unit;

circuitry configured to: (i) receive meta data identifying the media content transmitted by the media player, (ii) to track a current play position of the media content independent of the media player, (iii) detect a disconnect event between the media player and the input channel, and (iv) in response to the disconnect event, store the current play position tracked by the circuitry in the computer-readable memory.

20. The portable listening device set forth in claim 19 wherein the current play position of the media content is received by the portable listening device at regular intervals.

* * * * *